US009637695B2

(12) United States Patent
Zwart et al.

(10) Patent No.: US 9,637,695 B2
(45) Date of Patent: May 2, 2017

(54) REACTOR FOR PRODUCING A PRODUCT GAS FROM A FUEL

(71) Applicant: STICHTING ENERGIEONDERZOEK CENTRUM NEDERLAND, LE Petten (NL)

(72) Inventors: Robin Willem Rudolf Zwart, LE Petten (NL); Christiaan Martinus Van Der Meijden, LE Petten (NL); Abraham Van Der Drift, LE Petten (NL)

(73) Assignee: STICHTING ENERGIEONDERZOEK CENTRUM NEDERLAND, Petten (NL)

( * ) Notice: Subject to any disclaimer, the term of this patent is extended or adjusted under 35 U.S.C. 154(b) by 183 days.

(21) Appl. No.: 14/439,239

(22) PCT Filed: Oct. 30, 2013

(86) PCT No.: PCT/NL2013/050768

§ 371 (c)(1),
(2) Date: Apr. 29, 2015

(87) PCT Pub. No.: WO2014/070001

PCT Pub. Date: May 8, 2014

(65) Prior Publication Data

US 2015/0291896 A1 Oct. 15, 2015

(30) Foreign Application Priority Data

Oct. 31, 2012 (NL) ..... 2009733

(51) Int. Cl.

| | |
|---|---|
| ***C10J 3/46*** | (2006.01) |
| ***C10J 3/56*** | (2006.01) |
| ***C10J 3/48*** | (2006.01) |

(52) U.S. Cl.
CPC ..... *C10J 3/485* (2013.01); *C10J 2200/09* (2013.01); *C10J 2300/0916* (2013.01);
(Continued)

(58) Field of Classification Search
CPC C10J 3/48; C10J 3/56; C10J 3/58; C10J 3/74
See application file for complete search history.

(56) References Cited

U.S. PATENT DOCUMENTS 4,770,237 A * 9/1988 Morin ..... B01J 8/388 122/4 D
4,947,803 A * 8/1990 Zenz ..... F23C 10/02 110/245

(Continued)

FOREIGN PATENT DOCUMENTS

DE 2400528 A1 7/1975
EP 0844021 A2 5/1998

(Continued)

OTHER PUBLICATIONS

International Search Report, dated Jan. 20, 2014, from corresponding PCT application.

*Primary Examiner* — Matthew Merkling
(74) *Attorney, Agent, or Firm* — Young & Thompson

(57) ABSTRACT

Reactor for producing a product gas from a fuel having a housing (11, 12, 13) with a combustion part accommodating a fluidized bed (7) in operation, a riser (2) extending along a longitudinal direction of the reactor (1), and a downcomer (3) positioned coaxially around the riser (2) and extending into the fluidized bed (7). One or more feed channels (8) for providing the fuel to the riser (2) are provided. The riser (2) is attached to the housing (11, 12, 13) of the reactor (1) in a bottom part (13) of the housing (11, 12, 13), and a part of the riser (2) above the one or more feed channels (8) is moveable with respect to the downcomer (3) in the longitudinal direction of the reactor (1).

20 Claims, 2 Drawing Sheets

Figure 1:
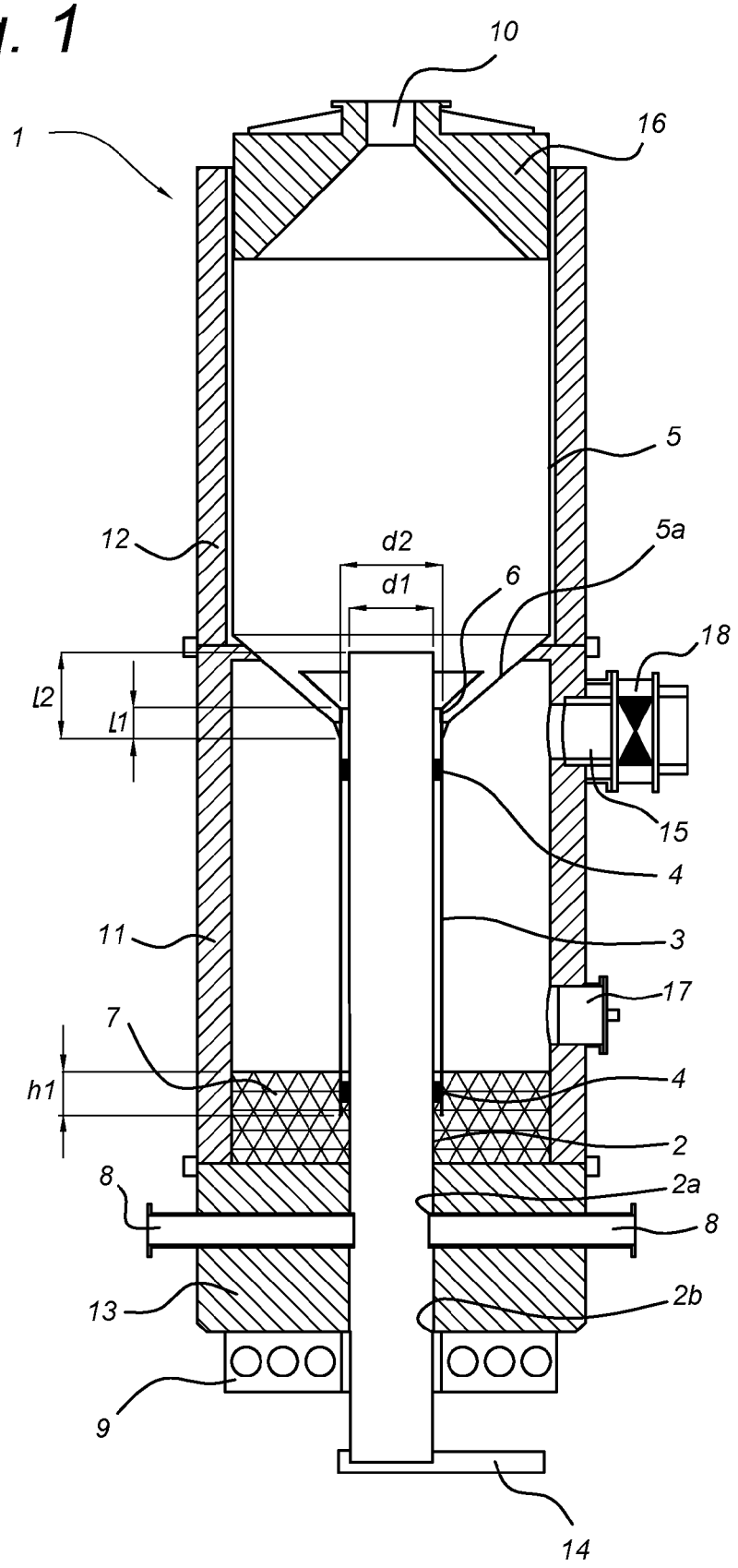

(52) U.S. Cl.
CPC ..... *C10J 2300/0959* (2013.01); *C10J 2300/1246* (2013.01); *C10J 2300/1603* (2013.01); *C10J 2300/1606* (2013.01); *C10J 2300/1637* (2013.01); *C10J 2300/1643* (2013.01); *C10J 2300/1807* (2013.01); *C10J 2300/1876* (2013.01)

(56) References Cited

U.S. PATENT DOCUMENTS 5,033,413 A * 7/1991 Zenz ..... F23C 10/02 110/245
6,119,607 A * 9/2000 Guy ..... F23G 5/04 110/245
8,685,122 B2 * 4/2014 Murakami ..... F23C 10/10 48/61
2010/0143208 A1 * 6/2010 Van Der Meijden .. B01J 8/1872 422/144

FOREIGN PATENT DOCUMENTS

GB 2021633 A 12/1979
WO 9943768 A1 9/1999
WO 2005037422 A1 4/2005
WO 2007061301 A1 5/2007
WO 2008108644 A1 9/2008

* cited by examiner

REACTOR FOR PRODUCING A PRODUCT GAS FROM A FUEL

FIELD OF THE INVENTION

The present invention relates to a reactor for producing a product gas from a fuel, comprising a housing with a combustion part accommodating a fluidized bed in operation, a riser extending along a longitudinal direction of the reactor, and a downcomer positioned coaxially around the riser and extending into the fluidized bed.

PRIOR ART

European patent publication EP-A-0 844 021 discloses a reactor for catalytic conversion of organic substances using a fluid bed reactor. The reactor comprises a centrally positioned riser, and a downcomer positioned coaxially around the riser.

International patent application WO2005/037422 discloses a circulating bed reactor having a riser and a separation unit. The riser is positioned centrally in a reactor housing wall, forming a return channel between the riser and the reactor housing wall.

International patent application WO2007/061301 discloses a riser having a lower end that is freely moveable with respect to the base part of the reactor.

SUMMARY OF THE INVENTION

The present invention seeks to provide an improved reactor for producing a product gas from a fuel, which is reliable and endurable, even after multiple starts and stops of the reactor.

According to the present invention, a reactor according to the preamble defined above is provided, further comprising one or more feed channels for providing the fuel to the riser, the riser being attached to the housing of the reactor in a bottom part of the housing, and a part of the riser above the one or more feed channels being moveable with respect to the downcomer in the longitudinal direction of the reactor . This assures that during operation (or better at start-up or stopping of the reactor) the riser can thermally expand with respect to the down corner channel, as a result of which no thermal fatigue of the reactor components occurs.

The one or more feed channels are oriented substantially perpendicular to the longitudinal direction of the reactor in an embodiment. Especially for biomass fed reactors, this allows an efficient operation. In a further embodiment, the riser comprises a feed opening for each of the one or more feed channels , the feed opening being arranged to allow relative movement of the riser with respect to the one or more feed channels (which are fixed in relation to the reactor housing) along a longitudinal direction of the riser. The feed opening 2*a* e.g. has an oval shape to allow this mutual movement. The space thus present between feed channel and riser does not compromise the correct operation of the reactor.

In a further embodiment, the riser extends below the bottom part of the housing of the reactor, and comprises an ash removal device at a closed off bottom end of the riser. The ash removal device is thus capable of effectively (gravity based) removing material from the reactor.

The difference between an outer diameter of the riser and an inner diameter of the downcomer is at least 2.5 cm, e.g. at least 5 cm, e.g. 7.5 cm in further embodiments, which guarantees a sufficient downward speed in the downcomer (in the order of 0.1 m/s). In a further definition of terms, a ratio of an outer diameter of the riser and an inner diameter of the downcomer is more than 0.75 (e.g. more than 0.8, e.g. equal to 0.838).

In an even further embodiment, the reactor further comprises a spacer element between the riser and the downcomer. Multiple spacer elements may be provided, also at different positions along the longitudinal axis of the reactor, allowing mutual movement of the riser and downcomer. The spacer element may be made of a thin material, preventing a possible full or partial blocking of the downcomer channel. In case of breaking of a spacer element, it is easily replaceable at a maintenance or inspection interval of the reactor.

The downcomer is connected to a (funnel shaped) separator element remote from the fluidized bed, effectively providing a closure of the combustion part of the reactor. The downcomer is provided with an extension part extending above the separator element in a further embodiment, which effectively prevents thermal shock effects at that location.

In an embodiment, the reactor further comprises one or more secondary downcomers, positioned parallel to the downcomer. This increases the downcomer capacity, and also allows to more provide a more efficient distribution inot the fluidized bed. The secondary downcomers may be provided with extension elements above the separator element.

In a further embodiment, the reactor further comprises a flue gas outlet, and a pressure control element in the flue gas outlet. This allows to provide a small pressure difference between upstream and downstream parts of the reactor in the order of 10 mbar, which in turn allows to provide gas leakage for temperature control inside the reactor.

In a further aspect, the present invention relates to the use of a reactor according to any one of the present invention embodiments for biomass gasification.

SHORT DESCRIPTION OF DRAWINGS

Figure 2:
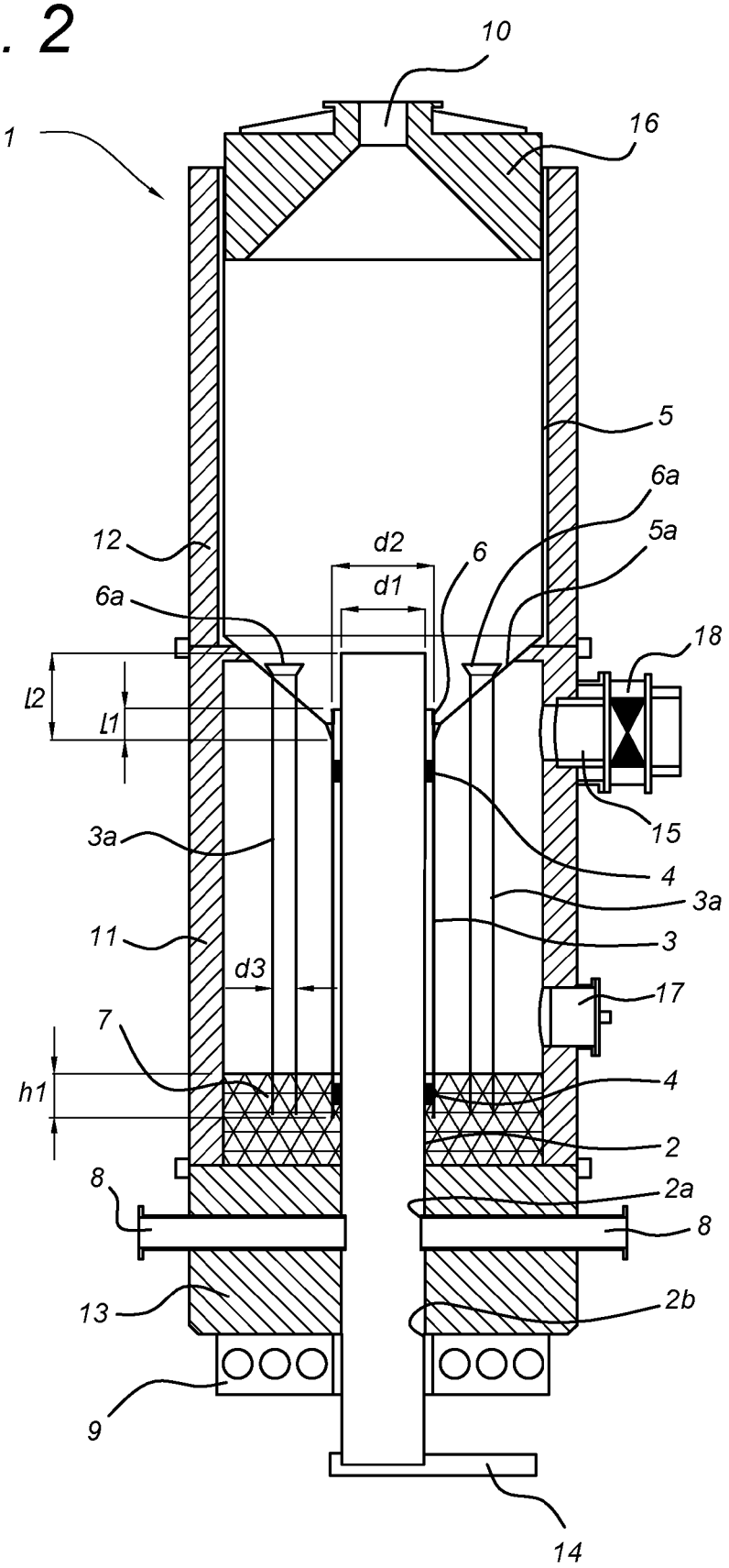

The present invention will be discussed in more detail below, using a number of exemplary embodiments, with reference to the attached drawings, in which FIG. 1 shows a cross sectional view of a reactor according to an embodiment of the present invention; and FIG. 2 shows a cross sectional view of a further reactor according to an embodiment of the present invention.

DETAILED DESCRIPTION OF EXEMPLARY EMBODIMENTS

A device for producing a product gas from biomass is known in the prior art, see e.g. international patent publication WO2008/108644 of the same applicant as the present application. Fuel (e.g. biomass) supplied to a riser in a reactor usually comprises 80% by weight of volatile constituents and 20% by weight of substantially solid carbon or char. Heating said biomass supplied to the riser to a suitable temperature in a low-oxygen, i.e. a substoichiometric amount of oxygen, or oxygen-free environment results in pyrolysis and gasification in the riser. Said suitable temperature in the riser is usually higher than 800° C., such as between 850-900° C.

The pyrolysis of the volatile constituents results in the creation of a product gas. The product gas is, for example, a gas mixture which comprises CO, $H_2$, $CH_4$ and optionally higher hydrocarbons. After further treatment, said combustible product gas is suitable for use as a fuel. Due to the low gasification speed, the char present in the biomass will gasify in the riser merely to a limited extent. The char is therefore usually combusted in a separate zone (combustion part) of the reactor.

During start-up of the installation, the temperature rises from room temperature to the pyrolysis and gasification temperature within a relatively short time. The riser is therefore subjected to a considerable degree of thermal expansion. This may result in damage to the riser, such as the formation of cracks, especially after multiple starts and stops of the reactor.

A cross sectional view of a reactor 1 according to an embodiment of the present invention s shown schematically in FIG. 1. The reactor 1 forms an indirect or allothermic gasifier which combines gasification for the volatile constituents and combustion for the char. As a result of indirect gasification, a fuel such as biomass is converted into a product gas which as end product or intermediate product is suitable as a fuel in, for example, boilers, gas engines and gas turbines.

The reactor 1 comprises a housing which in the embodiment shown is made up of a base part 13, a lower part housing 11 and a top part housing 12. These elements form the peripheral or circumferential wall of the reactor 1. At the top of the reactor 1 a product gas outlet 10 is provided in a top element 16 closing of the reactor 1 at the top.

The reactor 1 further comprises a riser 2, e.g. in the form of a centrally positioned tube, forming a riser channel in its interior. One or more feed tubes 8 are in communication with the riser 2 to transport the fuel for the reactor 1 to the riser 2. In the case the fuel is biomass, the one or more feed tubes 8 may be fitted with Archimedean screws to transport the biomass towards the riser 2 in a controlled manner. The one or more feed tubes 8 may furthermore be fixed in the base part 13 of the housing of the reactor 1. In an embodiment of the present invention, the feed tubes 8 are positioned substantially horizontal within the reactor 1 (i.e. perpendicular to the longitudinal direction of the reactor 1), allowing an efficient and effective assembly and operation of the reactor 1.

In a further embodiment, the riser 2 comprises a feed opening 2*a* for each of the one or more feed channels 8. This feed opening 2*a* is arranged to allow relative movement of the one or more feed channels 8 with respect to the riser 2 along a longitudinal direction of the riser 2. The feed opening e.g. has an oval shape, effectively allowing movement of the end of the feed channel 8. Of course, this creates a small opening towards the inside of the riser 2, but is has been shown during actual operation that this has no influence on proper operation of the reactor 1.

The top part of the reactor 1 comprises a top reactor wall 5 which narrows (e.g. using a funnel shaped part or separator element 5*a*) and attaches to a downcomer 3. Effectively, the top reactor wall 5 (and separator element 5*a*) form a separation between the combustion part (having a fluidized bed 7) and the pyrolysis part (in the riser channel inside the riser 2) of the reactor 1.

The downcomer 3 in this embodiment is positioned coaxial to the riser 2, along a major part of its length. This may be implemented using positioning elements 4 at one or more positions along the longitudinal direction of the riser 2. In the FIG. 1 embodiment, the downcomer 3 extends over a height $h_1$ into the fluidized bed 7 (where the riser extend through the entire fluidized bed 7).

In general wording, the reactor 1 comprising a housing 11, 12, 13 with a combustion part accommodating a fluidized bed 7 in operation, a riser 2 extending along a longitudinal direction of the reactor 1 (and defining a riser channel in its interior), a downcomer 3 positioned coaxially around the riser 2 (thus forming a downcomer channel) and extending into the fluidized bed 7, and one or more feed channels 8 for providing the fuel to the riser 2, the riser 2 being attached to the housing 11, 12, 13 of the reactor 1 in a bottom part 13 of the housing 11, 12, 13, and a part of the riser 2 above the one or more feed channels 8 being moveable with respect to downcomer 3 in the longitudinal direction of the reactor 1. For example, the riser 2 is welded or otherwise attached to a bottom rim of the bottom part of the housing 13, indicated by 2*b* in the FIG. 1 embodiment.

As shown in the FIG. 1 embodiment, the riser 2 extends below the bottom part 13 of the housing of the reactor 1. On the bottom side of the riser 2 (which has a closed off end), an ash removal device 14 is part of the reactor 1, allowing to remove material (ash, sand, debris, etc) from the interior of the reactor 1. Again, such ash removal device 14 may be provided with an Archimedean screw arrangement to efficiently remove ash, etc. from the riser 2.

The construction of the reactor as discussed above in several embodiments effectively allows the riser 2 to expand in the longitudinal direction of the reactor 1 during operation, under the influence of the high temperatures in the reactor, especially where pyrolysis takes place. Furthermore, this construction is simple and reliable, even after many starts and stops of operation of the reactor.

The positioning elements 4 may be used to maintain the mutual position of riser 2 and downcomer 3, even under operational conditions. The positioning elements 4 may be positioned at more than one location in the longitudinal direction of the reactor to provide sufficient support. The spacer elements 4 are attached to one of the riser 2 or downcomer 3, to allow mutual movement of the two, in a further embodiment.

The positioning elements 4 may be made of a thin material, thereby minimizing obstruction in the space between downcomer 3 and riser 2. Furthermore, a thin material will be less likely to cause material to build up around it, effectively preventing blockage of the downcomer channel. Even if one of the positioning elements 4 would be lost, the other remaining positioning elements 4 will be sufficient to uphold the function thereof until broken positioning elements 4 can be replaced (e.g. during a maintenance or inspection interval).

In an embodiment, the outer diameter $d_1$ of the riser 2 is about 85 cm, and the inner diameter $d_2$ of the downcomer 3 is about 100 cm, resulting in a difference of 15 cm (or in other words, a space of 7.5 cm in radial direction around the riser 2). More in general, a difference $d_2-d_1$ of at least 2.5 cm already provides for a sufficient high capacity of the downcomer channel to obtain a sufficient high speed of material downwards of approximately 0.1 m/s. A difference of at least 10 cm, or as mentioned above of 15 cm further enhances this capability, even under operational conditions.

In other wordings, the ratio of an outer diameter $d_1$ of the riser 2 and an inner diameter $d_2$ of the downcomer 3 is more than 0.75. It is noted that in the reactor embodiments disclosed in prior art document EP-A-0 844 021 as discussed above, this ratio is 0.727 (8 cm riser inside downcomer of 11 cm). With the embodiment examples described above, this ratio is higher than 0.8, i.e. equal to 0.838. Again, when specifically applied in biomass gasification processes, where sand including remaining material to be burnt is returned to the fluidized bed 7 using the downcomer channel, these dimensions allow for a proper and reliable operation. The sand with material to be burnt will flow down the downcomer channel into the fluidized bed 7 under gravity.

In the embodiment example shown in FIG. 1, the downcomer 3 has an extending part 6 at the top, which extends a predetermined distance $l_1$ above the separator element 5*a* of the top reactor wall 5. This has the advantage that during use, sand material utilized in the fluidizing bed 7 will remain laying in the space between the separating element 5*a* and extending part 6, forming an isolation layer. This will make the reactor parts at that location better resistant to possible temperature changes or shocks, e.g. at start up, when material from the riser channel (at pyrolysis temperature 800-900° C.) hits the separator element 5*a* (the combustion space next to it being at about 500° C.).

The extending part 6 may be a simple extension of the tube shape of the downcomer 3 (i.e. cylindrical), in an alternative embodiment the extending part 6 widens towards the top of the reactor 1 (e.g. as shown in the FIG. 1 embodiment, follows the surface of the separator element 5*a* along a predetermined length).

The riser 2 extends even further above the separator element 5*a*, over a length $l_2$ as indicated in the FIG. 1 embodiment.

Above the base part 13, a fluidized bed 7 is present during operation, which is fluidized using fluidization system 9. The fluidization system 9 is drawn below the base part 13 of the reactor 1, and may comprise tubes and channels in the base part 13 to allow to fluidize the bed 7 inside the bottom part of the reactor 1 (above base part 13 and surrounded by lower part housing 11). These tubes and channels ensure that the fluidized bed 7 is maintained during operation in the area outside the lower part of the downcomer 3 (no fluidized material is present in the downcomer 3 during operation).

Furthermore, the lower part housing 11 is provided with a flue gas outlet 15 allowing outflow of the flue gases produced in the fluid bed 7 part of the reactor 1. The flue gas outlet 15 is fitted with a pressure control element 18 in a further embodiment, which effectively allows to create a pressure difference between the pyrolysis part and combustion part of the reactor 1. The pressure difference range controllable by the pressure control element 18 is relatively low (in the order of magnitude of 10 mbar), but still allows to effectively apply temperature control in the reactor 1. This is accomplished by the pressure control resulting in gas leakage from the pyrolysis part of the reactor to the combustion part via the downcomer channel.

The lower part housing 11 is also provided with an additional closeable outlet 17, which may be used to control the level and constituency of the fluidized bed 7.

The processes in the reactor 1 thus comprises pyrolysis which takes place during operation in the riser 2. The remnants of the pyrolysis process are transported via the top reactor wall 5 and downcomer 3 into the fluidized bed 7, where further combustion takes place. The energy from this process is used to heat up the riser 2 for the pyrolysis process.

The embodiment as shown in the cross sectional view of FIG. 2 provides for a reactor with a higher capacity. Parallel to the downcomer 3, two auxiliary downcomers 3*a* are positioned. In the embodiment shown, the auxiliary downcomers have an inner diameter $d_3$ and are positioned at a radial distance from the longitudinal axis of the reactor 1. Additional material exiting from the top end of riser 2 can thus be transported to the fluidized bed 7. It will be clear that only one or more than two auxiliary downcomers 3*a* can be applied, with the number and inner diameter $d_3$ thereof adapted to the specific capacity increase needed for a specific application. The auxiliary downcomers 3*a* may be provided with extension elements 6*a* at the top part thereof (i.e. above the separation element 5*a*), e.g. in the form of funnel shaped or cylindrical extensions. This will prevent sand from the material to be returned to build up around edges of the auxiliary downcomers 3*a*, effectively preventing melting or sticking of the sand which might affect the capacity of the associated auxiliary downcomer 3*a*.

The present invention embodiments have been described above with reference to a number of exemplary embodiments as shown in the drawings. Modifications and alternative implementations of some parts or elements are possible, and are included in the scope of protection as defined in the appended claims.

The invention claimed is:

1. Reactor for producing a product gas from a fuel, comprising a housing (11, 12, 13) with a combustion part accommodating a fluidized bed (7) in operation, a riser (2) extending along a longitudinal direction of the reactor (1) and providing a pyrolysis part separate from the fluidized bed, a downcomer (3) positioned coaxially around the riser (2) and extending into the fluidized bed (7), and one or more feed channels (8) for providing the fuel to the riser (2), the riser (2) being attached to the housing (11, 12, 13) of the reactor (1) in a bottom part (13) of the housing (11, 12, 13), and a part of the riser (2) above the one or more feed channels (8) being moveable with respect to the downcomer (3) in the longitudinal direction of the reactor (1).

2. The reactor according to claim 1, wherein the one or more feed channels (8) are oriented substantially perpendicular to the longitudinal direction of the reactor (1).

3. The reactor according to claim 1, wherein the riser (2) comprises a feed opening (2*a*) for each of the one or more feed channels (8), the feed opening being arranged to allow relative movement of the riser (2) with respect to the one or more feed channels (8) along a longitudinal direction of the riser (2).

4. The reactor according to claim 1, wherein the riser (2) extends below the bottom part (13) of the housing (11, 12, 13) of the reactor (1), and comprises an ash removal device (14) at a closed off bottom end of the riser (2).

5. The reactor according to claim 1, wherein the difference between an outer diameter ($d_1$) of the riser (2) and an inner diameter ($d_2$) of the downcomer (3) is at least 2.5 cm.

6. The reactor according to claim 1, wherein a ratio of an outer diameter ($d_1$) of the riser (2) and an inner diameter ($d_2$) of the downcomer (3) is more than 0.75.

7. The reactor according to claim 1, further comprising a spacer element (4) between the riser (2) and the downcomer (3).

8. The reactor according to claim 7, wherein the spacer element (4) is made of a thin material.

9. The reactor according to claim 1, wherein the downcomer (3) is connected to a separator element (5*a*) remote from the fluidized bed (7).

10. The reactor according to claim 9, wherein the downcomer (3) is provided with an extension part (6) extending above the separator element (5*a*).

11. The reactor according to claim 10, further comprising one or more secondary downcomers (3*a*), positioned parallel to the downcomer (3).

12. The reactor according to claim 11, wherein the secondary downcomers (3*a*) are provided with extension parts (6*a*) extending above the separator element (5*a*).

13. The reactor according to claim 1, further comprising a flue gas outlet (15), and a pressure control element (18) in the flue gas outlet (15).

14. The reactor according to claim 2, wherein the riser (2) comprises a feed opening (2*a*) for each of the one or more feed channels (8), the feed opening being arranged to allow relative movement of the riser (2) with respect to the one or more feed channels (8) along a longitudinal direction of the riser (2).

15. The reactor according to claim 2, wherein the riser (2) extends below the bottom part (13) of the housing (11, 12, 13) of the reactor (1), and comprises an ash removal device (14) at a closed off bottom end of the riser (2).

16. The reactor according to claim 3, wherein the riser (2) extends below the bottom part (13) of the housing (11, 12, 13) of the reactor (1), and comprises an ash removal device (14) at a closed off bottom end of the riser (2).

17. The reactor according to claim 5, wherein the difference between an outer diameter ($d_1$) of the riser (2) and an inner diameter ($d_2$) of the downcomer (3) is at least 5 cm.

18. The reactor according to claim 17, wherein the difference between an outer diameter ($d_1$) of the riser (2) and an inner diameter ($d_2$) of the downcomer (3) is at least 7.5 cm.

19. The reactor according to claim 2, wherein a ratio of an outer diameter ($d_1$) of the riser (2) and an inner diameter ($d_2$) of the downcomer (3) is more than 0.75.

20. The reactor according to claim 1, further comprising one or more secondary downcomers (3*a*), positioned parallel to the downcomer (3).

* * * * *